US005751199A

United States Patent [19]

Shiau et al.

[11] Patent Number: 5,751,199

[45] Date of Patent: May 12, 1998

[54] COMBLINE MULTIPLEXER WITH PLANAR COMMON JUNCTION INPUT

[75] Inventors: Ming-Jong Shiau, Cerritos; John C. Tippet, Rancho Palos Verdes, both of Calif.

[73] Assignee: TRW Inc., Redondo Beach, Calif.

[21] Appl. No.: 587,081

[22] Filed: Jan. 16, 1996

[51] Int. Cl.[6] ..... H01P 1/213

[52] U.S. Cl. ..... 333/134; 333/203

[58] Field of Search ..... 333/125, 126, 333/129, 132, 134, 136, 202, 203

[56] References Cited

U.S. PATENT DOCUMENTS

| | | | |
|---|---|---|---|
| 3,875,538 | 4/1975 | Minet et al. | 333/204 |
| 4,091,344 | 5/1978 | LaTourrette | 333/134 |
| 4,210,881 | 7/1980 | Rubin | 333/110 |
| 4,450,421 | 5/1984 | Meguro et al. | 333/202 |
| 4,513,263 | 4/1985 | Minnis | 333/202 X |
| 5,023,579 | 6/1991 | Bentivenga et al. | 333/202 |
| 5,208,565 | 5/1993 | Sogo et al. | 333/206 |
| 5,281,934 | 1/1994 | Shiau et al. | 333/134 |
| 5,323,127 | 6/1994 | Komazaki et al. | 333/134 X |
| 5,428,325 | 6/1995 | Jachowski et al. | 333/203 |

OTHER PUBLICATIONS

Rhodes et al.; "MIC Broadband Filters and Contiguous Multiplexers", *Proceedings of the 9th European Microwave Conference;* Brighton, England, Sep. 17–20, 1979; pp. 407–411.

*Primary Examiner*—Robert Pascal
*Assistant Examiner*—Barbara Summons
*Attorney, Agent, or Firm*—Michael S. Yatsko

[57] ABSTRACT

A multioctave multiplexer (10) with multiple independent filter channels with a circuit topology that employs a planar circuit segment (18) and conventional combline resonator circuits (38), (40) and (42). The planar circuit segment (18) forms a common input (28) etched on a substrate and concurrently feeds RF signals to the independent channels (12), (14) and (16). The first planar circuit segment (18) comprises two unit elements (51) and (52) and a π-section capacitor network (54), (56) and (58). The second combline circuit segment (38) comprises shunt resonators (38*a*), (38*b*), and (38*c*) and inter-resonator inductors (44*a*), (44*b*) and (44*c*) . The first and second circuit segments generate a number of transmission zeros on a complex plane that is 2 at DC, 2N-4 at one-quarter wavelength and 2 at the complex frequency of S=+/−1 in the complex plane. The planar common junction multiplexer provides the advantages of low manufacturing cost and the ease of assembly of the prior art without sacrificing any loss in performance and equivalent performance of the more costly high precision conventional combline resonator multiplexers.

11 Claims, 3 Drawing Sheets

COMBLINE MULTIPLEXER WITH PLANAR COMMON JUNCTION INPUT

BACKGROUND

This invention relates to a common input, multioctave multiplexer and more particularly to a combline multiplexer with planar common junction inputs.

Many frequency-multiplexed applications require multiplexer devices that have a high Q, low loss, are small in terms of their physical dimensions, require less precision manufacturing techniques, and are low in cost. Certain applications such as communication satellites and avionic systems that require broad band antennas that perform such electronic functions as beam steering, target tracking and scan loss recovery could benefit from improved multiplexer devices. Typically, the broad band RF signals from array antennas must be frequency multiplexed into suboctave bands in order that they be combined into a beam forming network devices.

Prior known multiplexers are available that meet some of the criteria for the above-described applications, but they still require precision manufacturing techniques that turn out rather large bulky structures requiring precision assembly and therefore are costly to produce. Accordingly, there is a need for improved broad band as well as narrow band combline multiplexers.

The use of multichannel planar circuits embodying printed circuit resonators in a suspended or microstrip substrate and connected to a common input junction is disclosed in U.S. Pat. No. 5,281,934, assigned to the same assignee as this application. While such planar circuit multioctave microwave multiplexers with the common input has overcome a number of deficiencies of prior structures, it still lacks sufficiently high Q performance for many communication satellite and avionics type applications.

SUMMARY

Improved RF multioctave combline multiplexers are provided in accordance with this invention in which the multiplexers connect the multiple combline channel filters to a common input port. Each channel filter is made up of two circuit segments. A first segment which comprises two unit elements and a π-section network of capacitors which are planar circuits and a second circuit segment which is an array of combline resonators represented by the shunt inductors and capacitors and inter-resonator series coupled inductors. The first planar circuit segment merges all the segments of each independent channel into a common junction at the input port. The second segment represents the conventional implementation of combline resonators with each resonator being connected to the conductive housing which forms the connection to ground. Tuning of such combline resonators in the second circuit segment is accomplished by a threaded member in the top of each element and resonator coupling is controlled by adjusting the spacing between resonators through the use of set screws in the housing.

The unique features of the invention reside in the topology of the first planar circuit segment which includes two unit elements and a π-section capacitor circuit in combination with the second combline circuit segment. The value of the inductors and capacitor elements combined in the particular circuit topology results in a high Q and low loss multiplexer that can be constructed without the requirements for close tolerance machined parts and having small physical dimensions. The planar first circuit segment s suspended in an airline cavity and is connected to the second combline circuit segment of the filter circuit.

The design of a multiplexer that has a high Q value and eliminates the use of close tolerance precision machined parts starts with a transfer function analysis which provides the essential features of a linear network. The transfer function analysis represents the transmission zeros of the linear network. Transmission zeros, as is well-known, may be plotted on the real and imaginary axes of a complex plane or an S-plane.

The critical performance characteristics of the multiplexer, are measured by its various loss conditions such as transmission loss, insertion loss, and return loss. These losses are primarily a function of the placement of the transmission zeros in the complex frequency plane. In the instant invention, a combination of the first and second circuit segments places the transmission zeros on a complex plane such that at DC the number of transmission zeros is 2, at a quarter wavelength or at infinity the number of transmission zeros is 2N-4 where N is the number of resonators in a channel filter, and the number of unit elements corresponding to transmission zero at S=+1and−1 is 2.

There are numerous multiplexer circuits that can be implemented as represented by the complex plane diagram where the number of transmission zero is 2 at DC, 2N-4 at a quarter wavelength, and 2 at S=+1and−1 in the complex frequency plane. However, implementation of the complex frequency diagram is uniquely accomplished by the circuit topology of the instant invention. It preferably should meet the critical objectives of this invention that it be low cost in terms of manufacturing and simple to assemble due to the common planar input junction and the unique arrangement of planar circuits contiguous with the combline resonator circuit segment. This circuit topology provides the high performance in terms of its Q and eliminates the high cost and labor-intensive assembly of prior art devices.

The desired performance characteristics of the multiplexer is depicted by its transmission loss and return loss which block the frequencies of the offending signals and are primarily a function of the placement of the transmission zeros in a complex frequency plot of the filter circuit.

It is a principal object of this invention to provide a multiplexer having a plurality of independent channels comprising a coplanar π-section network of capacitors/unit element circuit having a common input junction and a nonplanar combline resonator circuit segment.

It is a further object of this invention to provide a multioctave microwave multiplexer possessing the attributes of low fabrication cost, planar common input function having a specified complement of transmission zeros, and generally provides a high Q.

It is another object of this invention to provide a multioctave microwave multiplexer that avoids the use of machined parts requiring very close manufacturing tolerances, whose manufacture and assembly is uncomplicated and requires significantly less tuning and adjustment and delivers high Q performance at low cost.

DRAWINGS

These and other features, aspects, and advantages of the present invention will become better understood from the following description, appended claims, and accompanying drawings:

DESCRIPTION

Figure 1:
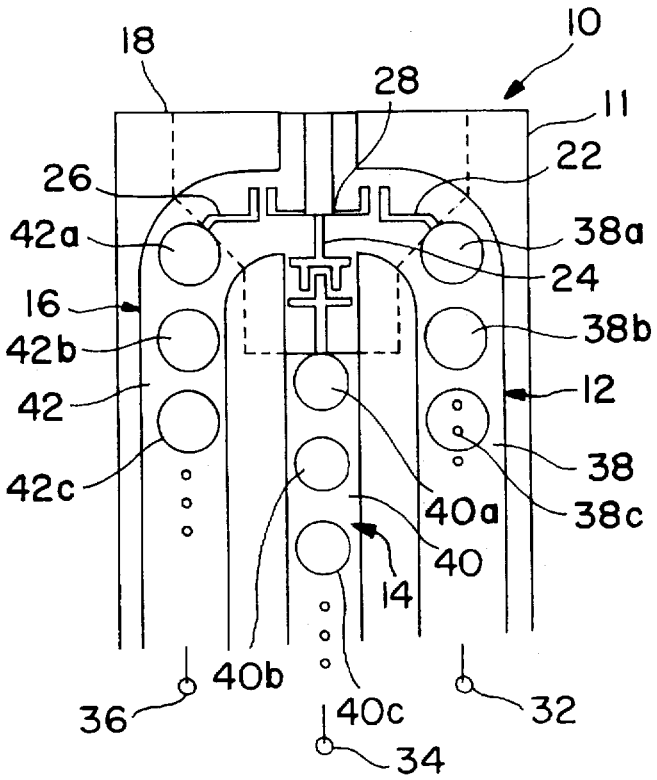
FIG. 1 is a plan view of the preferred embodiment of this invention showing a common junction input port comprising a planar π-section network of capacitor/unit element feed and the combline resonators.

Referring to FIG. 1 there is shown the preferred embodiment of a 3-channel multioctave multiplexer identified generally with the numeral 10. The multiplexer 10 includes three independent channels 12, 14, and 16, respectively. A planar circuit 18 is shown within the dotted outline portion and comprises a π-section network of capacitor/unit element feeds 22, 24, and 26 which connect to the common input junction 28. Each channel 12, 14, and 16 has an output port 32, 34, and 36, respectively.

Each channel is comprised of a first planar circuit segment 22, 24, and 26 and second circuit segments 38, 40, and 42 of conventional combline resonators. Each channel filter has an array of combline resonators 38*a*, 38*b*, and 38*c*, resonators 40*a*, 40*b*, and 40*c*, and resonators 42*a*, 42*b*, and 42*c* form part of channels 12, 14, and 16, respectively. It will be appreciated that the multiplexer 10 of this invention has its planar circuit 18 integrated and connected to each independent resonator filter channel 38, 40, and 42. Each of the elements of the planar circuit are coupled together and connected to the common junction 28 so that they function through the common junction input 28. The planar portions 22, 24, and 26 of channels 12, 14, and 16 are mounted on a substrate of dielectric material which is 0.020 inches thick.

Figure 2:
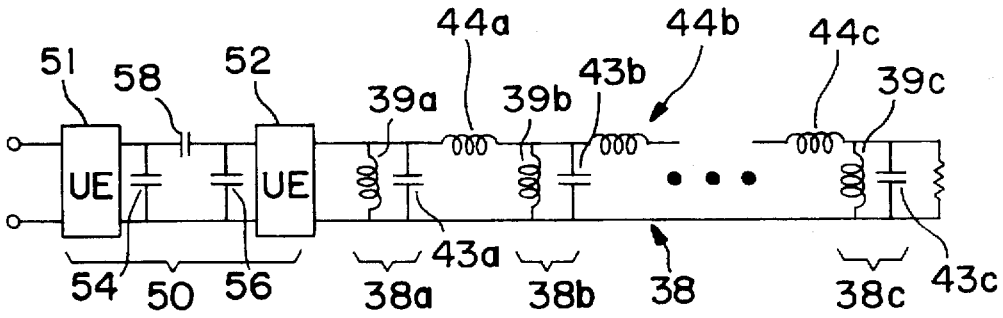
FIG. 2 is a network diagram of a channel filter of FIG. 1.

The feature of the combined planar circuit segment 18 and the resonator channel arrays 38, 40, and 42 connected to the planar circuit provide a unique transmission zero placement response to the multioctave RF signal input to the multiplexer. Referring now to FIG. 2, there is shown a network diagram of one of the independent channels 12 with its resonators 38*a*, 38*b*, and 38*c* connected to the planar circuit segment 18. It will be understood that the other channels 14 and 16 have the same circuit topology. The π-section network capacitor/unit element feed circuit shown in FIG. 2 is made of two unit elements 51 and 52 in parallel connection with two shunt capacitors 54 and 56 and are in series connection with capacitor 58.

Channel 38 of the second circuit comprises direct coupled band pass filter resonators 38*a*, 38*b*, and 38*c*. Each resonator includes inductances 39*a*, 39*b*, and 39*c* which are in parallel with capacitances 43*a*, 43*b*, and 43*c*, respectively. In series connection with each of the resonators 38*a*, 38*b*, and 38*c* is an inductances 44*a*, 44*b*, and 44*c*. In FIG. 2 the planar circuit segment 50 uses two unit element feeds 51 and 52 in parallel with the two shunt capacitances 54 and 56. In series connection with the two unit elements is a capacitor 58. Capacitances 54, 56 and 58 form a so-called "π-section capacitor" network. Tuning of the band pass filter of FIG. 2 can be accomplished by varying the lengths of the resonators 38*a*, 38*b*, or 38*c* or by the capacitive or inductive loading of each of the resonators. For example 38*a* and 38*b* have a length in the range of 0.45 to 0.56 inches for the quarter wave frequency at 6.0 GHz, preferably 0.49 inches. The impedance value of the circuit is in the range of 60.0 to 80.0 ohms.

As an illustration of its operation (See FIG. 1), the common junction portion 28 receives an input signal having a frequency range of between about 3 and 18 GHz. Each channel 12, 14, or 16 receives the same multioctave signal. Channel 12 provides an output signal preferably in the range of 3 to 5.5 GHz; channel 14 is input the same signal and it outputs a signal preferably in the range of 5.5 to 10 GHz. The third channel 16, processing the same input signal, preferably outputs in the range of 10 to 18 GHz. It will be understood that what is described as a high-frequency band pass multioctave multiplexer is applicable to a wide range of frequencies which would include narrow band as well. It will also be appreciated that the invention is not limited to any specific number of resonators in each independent channel and the features and advantages can be applied to a range of independent channels from 2 to 5 or 6 with the channels being contiguous or non-contiguous.

Figure 3:
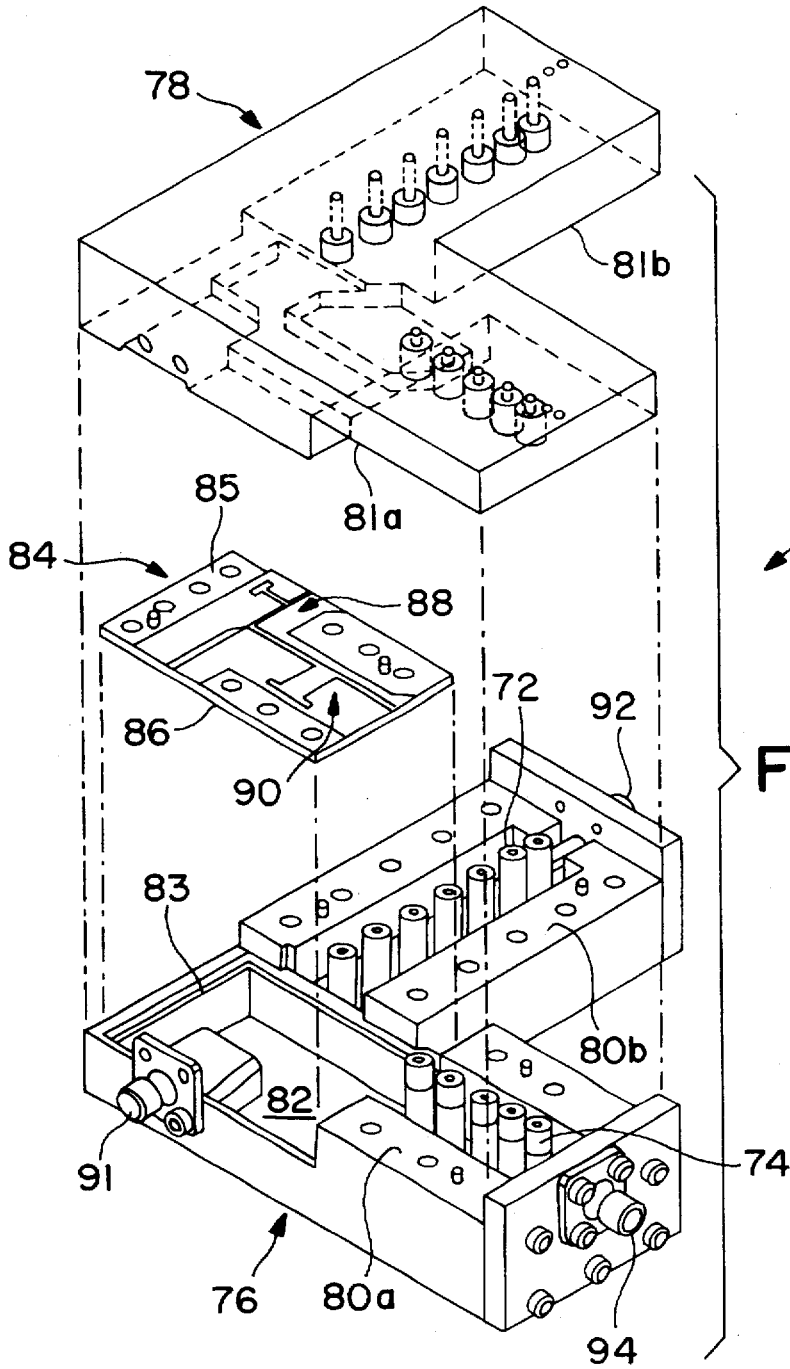
FIG. 3 is an exploded perspective view of a common input junction showing the planar circuit of a suspended substrate in a diplexer microwave filter.

Referring now to FIG. 3, there is shown an alternate embodiment of a multiplexer 70 which employs two independent filter channels 72 and 74. The diplexer 70 is formed with a base unit 76 and a cover unit 78. The base unit 76 includes a plurality of upper surfaces 80*a* and 80*b* which mirror a plurality of surfaces 81*a* and 81*b* on the underside of the cover 78. The base unit is equipped with a cutout or recessed portion 82 adapted to receive a planar circuit 84. The planar circuit 84 is formed on a dielectric substrate or support 86, such as TEFLON, a trademark of the DuPont Company for polytetrafluoroethylene impregnated with glass fibers. The circuit 84 includes two independent πsection network capacitor/unit element feeds 88 and 90.

Upon assembly of the cover 78 with the base unit 76 the upper surfaces 80*a* and 80*b* are matingly engaged with the underside surfaces of the cover 81*a* and 81*b* respectively. The base unit 76 is constructed so the edge portions of the planar circuit board 84 is supported by a series of flanges (not shown) along the perimeter 83 of the recess portion 82. When the cover is assembled with the base unit 76 the upper surfaces 80*a* and 80*b* are matingly engaged with the undersurfaces of the cover 81*a* and 81*b*, respectively, leaving an opening or an air line between the two units. In this manner the planar circuit board 84 is suspended in an airline opening formed between the base unit 76 and the cover 78.

Each of the channel filters 72 and 74 is connected to the common junction input 91 with independent output ports 92 and 94, respectively. In practice, the thickness of the substrate is in the preferred range of 0.015 to 0.030 inches. However, the thickness may vary to accommodate specific applications.

In practice the diplexer may receive at its common junction port 91 an RF signal in the frequency range of about 0.8 to 3.2 GHz. The channels 72 and 74 simultaneously receive the multioctave RF signal. Channel 72 filters the signals and outputs an RF signal in the frequency range of 0.8 to 1.6 GHz at its output port 92. Filter 74 concurrently processes the input multioctave RF signal and outputs and a signal having a frequency in the range of 1.6 to 3.2 GHz. The operation of the diplexer 70 separates the incoming signals into contiguous frequencies.

Figure 4:
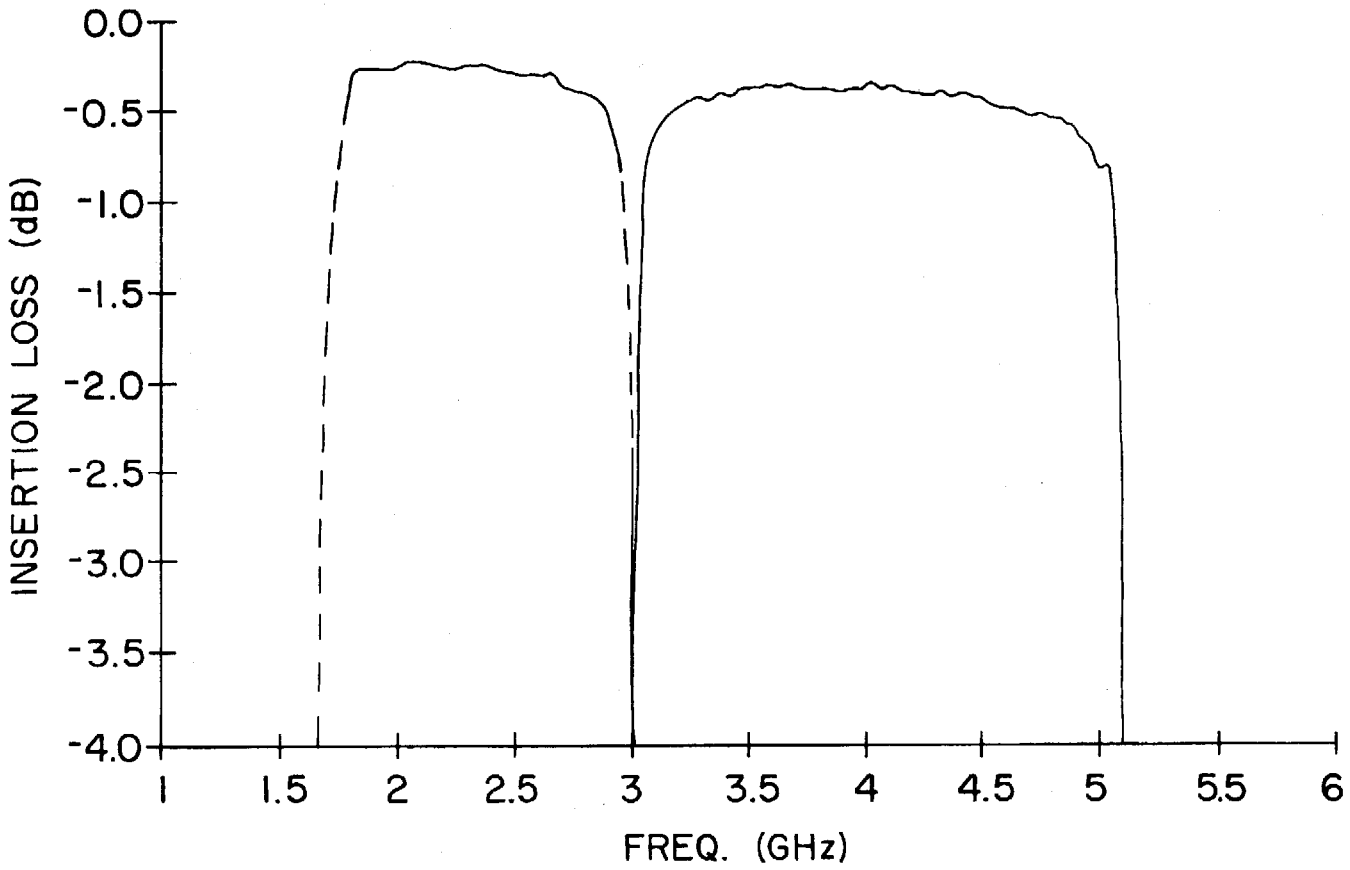
FIG. 4 is a performance plot showing the insertion loss of the diplexer of FIG. 3 which is comparable to the prior art multiplexers over the frequency range.

FIG. 4 is a plot of the insertion loss (dB) versus the frequency for the diplexer 70 of this invention. It is seen that the loss over the frequency range of the diplexer is approaching the level of zero (between −0.4dB and −0.25dB). The insertion loss is inversely proportional to the value for Q. As the insertion loss approaches zero, the value for Q would be high, and as the insertion loss dB becomes more negative, Q decreases. Performance value for Q for the diplexer in FIG. 3 was 850, which is on par with the complex mechanical structure of the conventional prior art combline multiplexer. The Q for the planar circuit multiplexer was 425.

Although the present invention has been described in considerable detail with reference to certain preferred versions thereof, other versions are possible. Therefore, the spirit and scope of the appended claims should not be limited to the description of the preferred versions contained herein.

What is claimed is:

1. A multioctave multiplexer having multiple independent filter channels in which each channel has a first planar circuit and a second combline resonator circuit comprised of N number of resonators;

said first planar circuit including means for concurrently feeding RF signals to said independent channels, and means within said first planar circuit and second combline resonator circuit of each channel, comprising a predetermined value of N for generating a set of transmission zeros that is 2 at DC, 2N-4 at one-quarter wavelength and 2 at the complex frequency of S=1 and S=−1 in the complex plane.

2. The multiplexer as claimed in claim 1 wherein each said first planar circuit comprises two unit elements and a $\pi$-section capacitor network.

3. The multiplexer as claimed in claim 1 wherein each said second combline resonator circuit comprises series shunt inductances and capacitances and inter-resonator coupling inductances.

4. The multiplexer as claimed in claim 1 wherein the number of independent filter channels is 3.

5. The multiplexer as claimed in claim 1 wherein the number of independent filter channels is 2.

6. The multiplexer as claimed in claim 1 wherein the number of unit elements corresponding to transmission zeros at S=+1 and S=−1 is 2.

7. The multiplexer as claimed in claim 1 wherein the independent channels are contiguous.

8. The multiplexer as claimed in claim 1 wherein the independent channels are non-contiguous.

9. The multiplexer as claimed in claim 1 wherein the first planar circuit is suspended in an airline cavity within the multiplexer.

10. A multioctave multiplexer having multiple independent filter channels, each channel adapted for filtering out a predetermined band of frequencies as a function of the number of resonators in each channel, and in which any one channel has N number of resonators, said filter channels comprising a first planar circuit and a second combline resonator circuit;

each said first planar circuit including means for forming a common input junction for simultaneously receiving RF signals and comprising two unit feed elements and pi ($\pi$) section capacitor networks etched on a substrate;

each said second resonator circuit comprising cavity means for receiving the resonators uniformly and equidistantly placed within said cavity and comprising series shunt inductances and capacitances and inter-resonator coupling inductances, whereby the multiplexer generates a transmission zero response that is 2 at DC, 2N-4 at one-quarter wavelength and 2 at the complex frequency of S=+1 and S=−1 in the complex plane.

11. A multioctave multiplexer having multiple independent filter channels, each channel adapted for filtering out a predetermined band of frequencies as a function of the number of resonators in each channel and in which any one channel has N number of resonators, said multiplexer comprised of a first planar circuit and a second combline resonator circuit;

said first planar circuit including means for concurrently feeding RF signals to said independent channels, and means within each of said first planar and second combline resonator circuits for generating a number of transmission zeros response that is 2 at DC, 2N-4 at one-quarter wavelength and 2 at the complex frequency of S=+1 and S=−1 in the complex plane.

* * * * *